US005931024A

United States Patent [19]

Honeycutt

[11] Patent Number: 5,931,024

[45] Date of Patent: Aug. 3, 1999

[54] CIRCULAR KNITTING MACHINE FOR PRODUCING AN ARTICLE HAVING A CLOSED END

[75] Inventor: Larry W. Honeycutt, P. O. Box 86, Concord, N.C. 27026

[73] Assignee: Larry W. Honeycutt, Concord, N.C.

[21] Appl. No.: 08/959,494

[22] Filed: Oct. 28, 1997

[51] Int. Cl.[6] ..... D04B 35/00

[52] U.S. Cl. ..... 66/147; 66/149 S; 156/251; 156/515; 83/937

[58] Field of Search ..... 66/149 S, 147; 156/251, 515; 264/145, 160; 83/937

[56] References Cited

U.S. PATENT DOCUMENTS

| | | | |
|---|---|---|---|
| 3,550,402 | 12/1970 | Colton | 66/147 |
| 3,738,123 | 6/1973 | Mazzi . | |
| 3,745,794 | 7/1973 | Brackett et al. | 66/149 S |
| 3,926,015 | 12/1975 | Sangiacomo | 66/147 |
| 4,069,090 | 1/1978 | Boyer . | |
| 4,102,727 | 7/1978 | Bell | 156/251 |
| 4,157,651 | 6/1979 | Coggins et al. | 66/147 |
| 4,250,723 | 2/1981 | Harill | 66/149 S |
| 4,454,730 | 6/1984 | Gregory et al. | 66/149 S |
| 4,773,237 | 9/1988 | Lonati | 66/149 S |
| 5,417,089 | 5/1995 | Honeycutt . | |

*Primary Examiner*—Andy Falik
*Attorney, Agent, or Firm*—Rhodes, Coats & Bennett, L.L.P.

[57] ABSTRACT

A circular knitting machine for producing a tubular knitted article having a closed end. The apparatus includes a circular knitting element for forming the tubular knitted article and a closure assembly located downstream of the circular knitting element for forming the closed end. An accumulator assembly is located between the circular knitting element and the closure assembly to provide tension to the tubular knitted article when the closure assembly is closed, thereby permitting the circular knitting element to continuously form the tubular knitted article during the operation of the closure assembly. Also, in the preferred embodiment, a cutting assembly is located between the accumulator assembly and the closure assembly, the cutting assembly being selectively operable to cut the tubular knitted article during the operation of the closure assembly.

45 Claims, 4 Drawing Sheets

CIRCULAR KNITTING MACHINE FOR PRODUCING AN ARTICLE HAVING A CLOSED END

BACKGROUND OF THE INVENTION (1) Field of the Invention

The present invention relates generally to circular knitting machines and, more particularly, to a circular knitting machine for producing a tubular knitted article having a closed end, such as a "socky" worn by a woman customer trying on new shoes.

(2) Description of the Prior Art

In the production of circular-knit hosiery, one end of a knitted tubular article is closed to form the toe. Traditional methods for closing the end of a tubular fabric include difficult and expensive operations. These operations are usually performed separately from the knitting operations, are relatively costly, and result in lower productivity.

One prior art solution was to close the end of the tubular fabric while it is still on a circular knitting machine. More specifically, hot knife cutting and fusion is disclosed in U.S. Pat. No. 4,069,090. However, a heated tool used for cutting and fusion produces build-up on the tool face, which requires regular cleaning, and therefore machine down-time, in order to ensure consistent fabric closure and sealing.

Another prior art solution was to incorporate an end closure apparatus which used a hot air nozzle to close the tubular knit fabric ends, as disclosed in U.S. Pat. No. 5,417,089, which is hereby incorporated by reference, in its entirety. However, the end closure apparatus required machine operation cycle interruption, thus reducing productivity by increasing machine cycle time. Additionally, no means for automatically detecting and controlling fabric length and activating the end closure apparatus accordingly is disclosed; fabric tension cannot be maintained while the end closure apparatus is activated. Therefore, the circular knitting machine operating cycle is necessarily interrupted by activation of the end closure apparatus.

Further, the prior art describes a vacuum operated tensioning device to maintain tension on the tubular fabric during the fabric cutting and closure functions. For example, U.S. Pat. No. 3,738,123, which is hereby incorporated by reference in its entirety, discloses a tensioning device for circular knitting machines including a control valve which enables suction to be applied selectively and alternately to a discharge conduit and a perforate duct to control fabric tension during machine operation. No cutting or end closure means is disclosed or suggested by this reference.

Problems associated with prior art methods of closing the end of the tubular fabric while it is still on a circular knitting machine include interrupting the machine operating cycle to perform the closure, unreliable closure of the tubular knit article, and manual operation or cleaning of the closure-forming element. These problems contribute to lower product quality, higher cycle times, and higher costs.

Thus, there remains a need for a new and improved circular knitting machine for automatically producing a tubular article having a closed end, without interrupting the machine operating cycle, thereby providing significant increases in production.

SUMMARY OF THE INVENTION

The present invention is directed to a circular knitting machine for producing a tubular knitted article having a closed end. The apparatus includes a circular knitting element for forming the tubular knitted article and a closure assembly located downstream of the circular knitting element for forming the closed end. An accumulator assembly is located between the circular knitting element and the closure assembly.

In the preferred embodiment, the accumulator assembly includes a tube connected located between the circular knitting element and the closure assembly and a first vacuum source connected to the tube. A control system selectively engages the first vacuum source in response to the operation of the closure assembly to provide tension to the tubular knitted article when the closure assembly is closed, thereby permitting the circular knitting element to continuously form the tubular knitted article during the operation of the closure assembly.

Also, in the preferred embodiment, a cutting assembly is located between the accumulator assembly and the closure assembly, the cutting assembly being selectively operable to cut the tubular knitted article during the operation of the closure assembly.

Accordingly, one aspect of the present invention is to provide a circular knitting machine for producing a tubular knitted article having a closed end. The apparatus includes: (a) a circular knitting element for forming the tubular knitted article; (b) a closure assembly located downstream of the circular knitting element for forming the closed end; and (c) an accumulator assembly located between the circular knitting element and the closure assembly, the accumulator being selectively operable to permit the circular knitting element to continuously form the tubular knitted article during the operation of the closure assembly.

Another aspect of the present invention is to provide an accumulator assembly for a circular knitting machine for producing a tubular knitted article having a closed end, the circular knitting machine including a circular knitting element for forming the tubular knitted article and a closure assembly located downstream of the circular knitting element for forming the closed end. The apparatus includes: (a) a tube connected located between the circular knitting element and the closure assembly; (b) a first vacuum source connected to the tube; (c) a control system for selectively engaging the first vacuum source in response to the operation of the closure assembly to provide tension to the tubular knitted article when the closure assembly is closed, thereby permitting the circular knitting element to continuously form the tubular knitted article during the operation of the closure assembly.

Still another aspect of the present invention is to provide a circular knitting machine for producing a tubular knitted article having a closed end. The apparatus includes: (a) a circular knitting element for forming the tubular knitted article; (b) a closure assembly located downstream of the circular knitting element for forming the closed end; (c) an accumulator assembly located between the circular knitting element and the closure assembly, the accumulator assembly including: (i) a tube connected located between the circular knitting element and the closure assembly; (ii) a first vacuum source connected to the tube; and (iii) a control system for selectively engaging the first vacuum source in response to the operation of the closure assembly to provide tension to the tubular knitted article when the closure assembly is closed, thereby permitting the circular knitting element to continuously form the tubular knitted article during the operation of the closure assembly; and (d) a cutting assembly located between the accumulator assembly and the closure assembly, the cutting assembly being selectively operable to cut the tubular knitted article during the operation of the closure assembly.

These and other aspects of the present invention will become apparent to those skilled in the art after a reading of the following description of the preferred embodiment when considered with the drawings.

DESCRIPTION OF THE PREFERRED EMBODIMENTS

Figure 1:
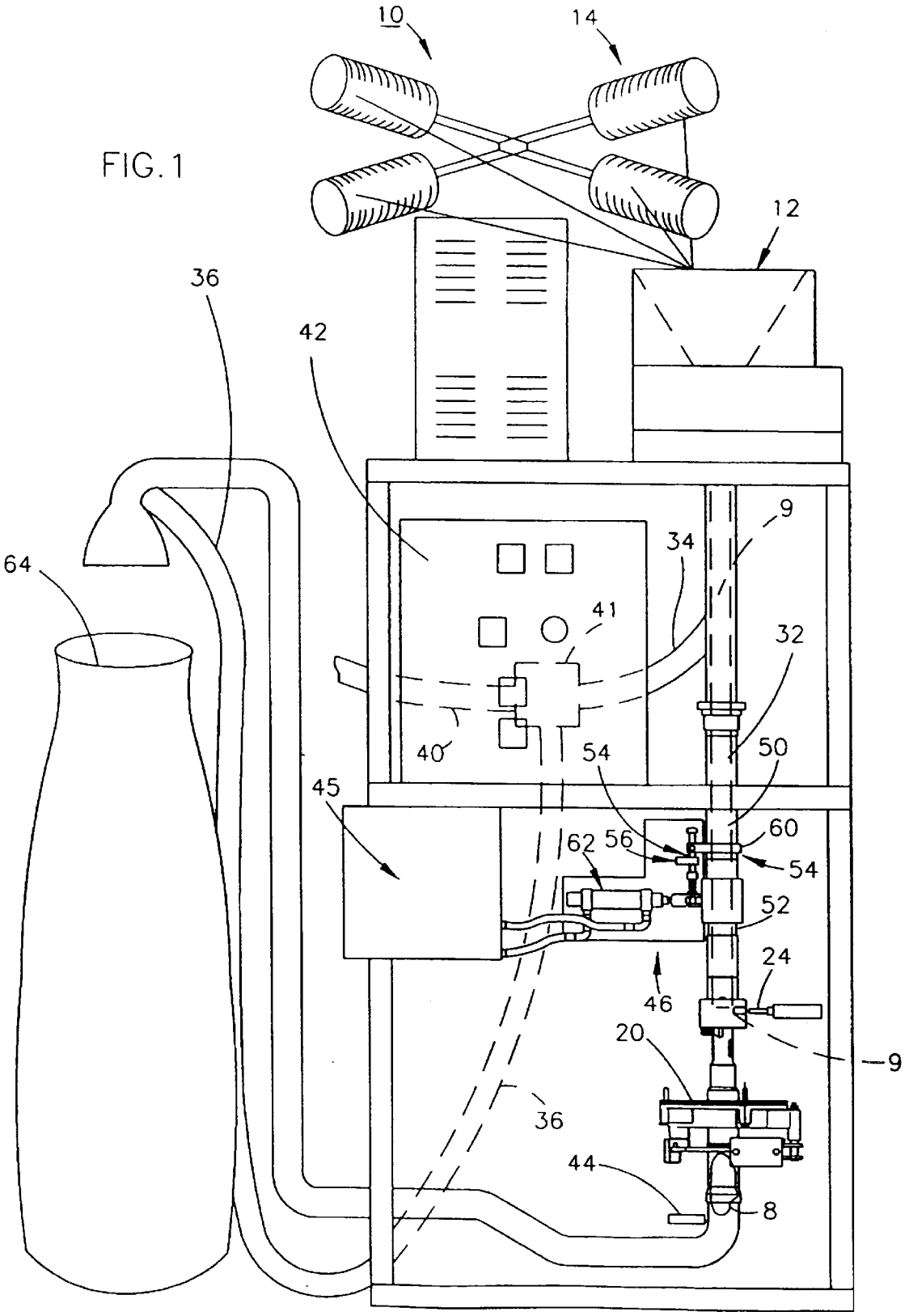
FIG. 1 illustrates a front elevational view of a circular knitting machine for producing a tubular knitted article having a closed end, constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a circular knitting machine for producing a tubular article having a closed end, indicated generally by the numeral 10, is shown according to the present invention. The circular knitting machine 10 comprises a circular knitting element 12, a yarn package feed system 14, preferably supplying four packages of twenty denier nylon yarn, located upstream from the circular knitting element 12 for supplying yarn for knitting a tubular article 8. The circular knitting element 12 further comprises a cam ring, needles, and sinkers (not shown), and is well known in the prior art.

In a preferred embodiment, the circular knitting element comprises 272 needles, for producing a tubular knit article 8 having a cross-stretch value of approximately between about 12 and 16 inches when tested on a STRETCHET machine, produced by Joseph C. Corbet Assoc., Concord, N.C. Typically, 340 needles are used in a circular knitting element, which produces a tubular knit article having a cross-stretch value approximately about 21 inches, as tested by the same method. Therefore, a tubular knit article 8 produced by a preferred embodiment using fewer needles saves approximately 12% yarn input.

As further seen in FIG. 1, the tubular knit fabric 9 produced by the circular knitting element 12 passes through an accumulator tube 32 which extends downwardly to connect with a cutting assembly 45 comprising a plenum 46, a first extension tube 50 located upstream from a cutting means 56, preferably comprising an actuator 62 for mechanically activating a pair of scissors 60 used for severing the tubular knitted fabric 9 to form a tubular knitted article 8, a second extension tube 52 fixedly located downstream from the first extension tube thereby forming a gap 54 therebetween for inserting the scissors 60.

Figure 3:
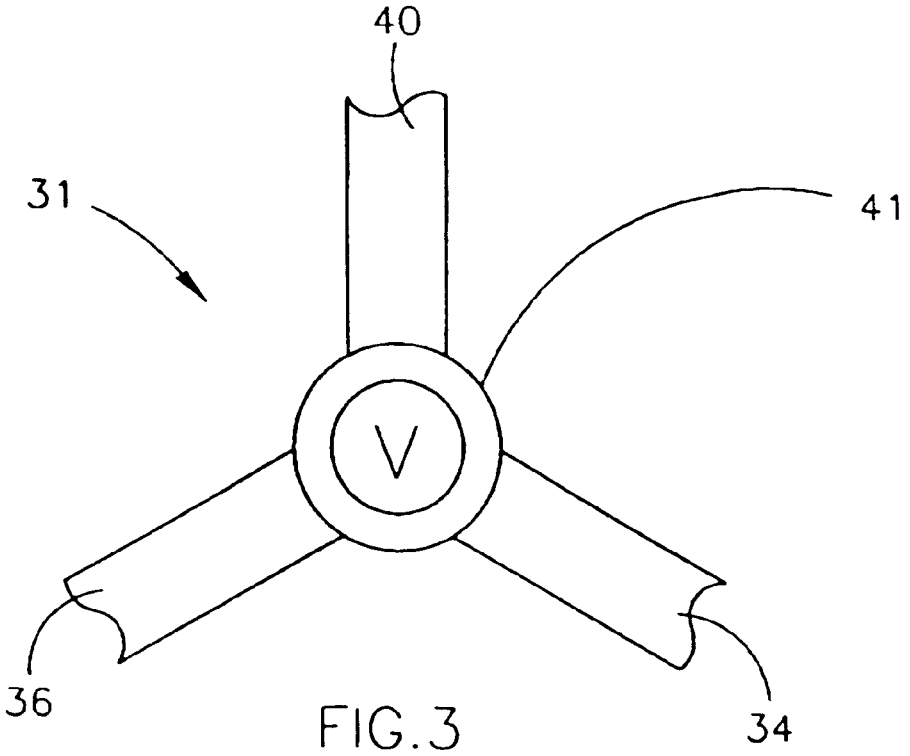
FIG. 3 illustrates a back enlarged view of the vacuum source arrangement of the circular knitting machine for producing a tubular article having a closed end.

In a preferred embodiment, the tubular knitted fabric 9 is maintained under constant tension via an accumulator assembly 31 which comprises the accumulator tube 32, a main vacuum line 40 having a solenoid (not shown) for selectively switching and alternately directing vacuum flow via a diverter valve 41, preferably a butterfly valve, between a first vacuum source 34 located upstream from an end closure assembly 20 and a second vacuum source 36 located downstream from the end closure assembly, as best seen in FIG. 3.

The accumulator assembly 31 is activated by a control system 42 for automatically controlling tension in the tubular knitted fabric 9, and for automatically activating the cutting assembly 45 and end closure assembly 20, during operation of the circular knitting machine 10, thereby allowing for continuous, uninterrupted machine operation, even when the tubular knit article 8 cutting and end closure functions occur.

Figure 5A:
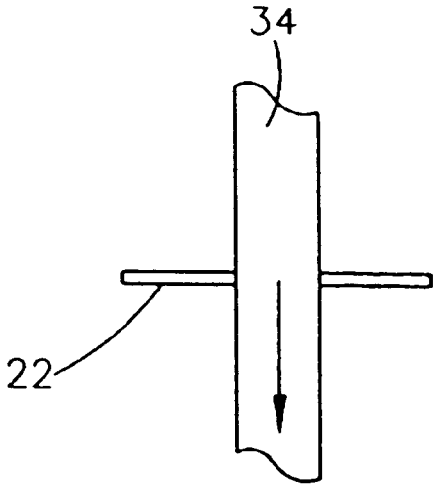
FIGS. 5(*a*) and 5(*b*) illustrate a schematic view of the accumulator assembly reverse vacuum flow.
Figure 5B:
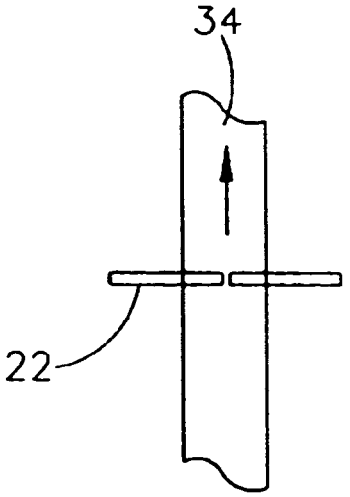

In a preferred embodiment, the cutting assembly 45 actuator 62 functions to activate the scissors 60 within a frame of one second. Further, in a preferred embodiment, as best seen in FIGS. 5(*a*) and 5(*b*), the accumulator assembly functions in controlled relation to a tube constrictor 22 via the control system 42. When the tube constrictor 22 is open, as seen in FIG. 5(*a*), the vacuum enables the second vacuum source 36 to supply vacuum to provide tension in the tubular knitted fabric 9, and to pull the tubular knitted article 8 into a collection container 64. When the tube constrictor 22 is closed, the diverter valve 41 redirects vacuum to the first vacuum source 34 to supply tension on the tubular knitted fabric 9 while the cutting assembly 45 and an end closure assembly 20 are activated, thereby allowing continuous operation of the circular knitting machine 10.

The reverse vacuum effect produced when the first vacuum source 34 is redirected, as described in the foregoing, serves two purposes. First, the reverse vacuum effect provides tension on the tubular knitted fabric 9 as it exits the circular knitting element 12 and proceeds downstream. Second, when the tube constrictor 22 is closed, a preselected length of tubular knitted fabric 9 is automatically cut and fused. These two functions occur simultaneously, and are further described herein.

Figure 2:
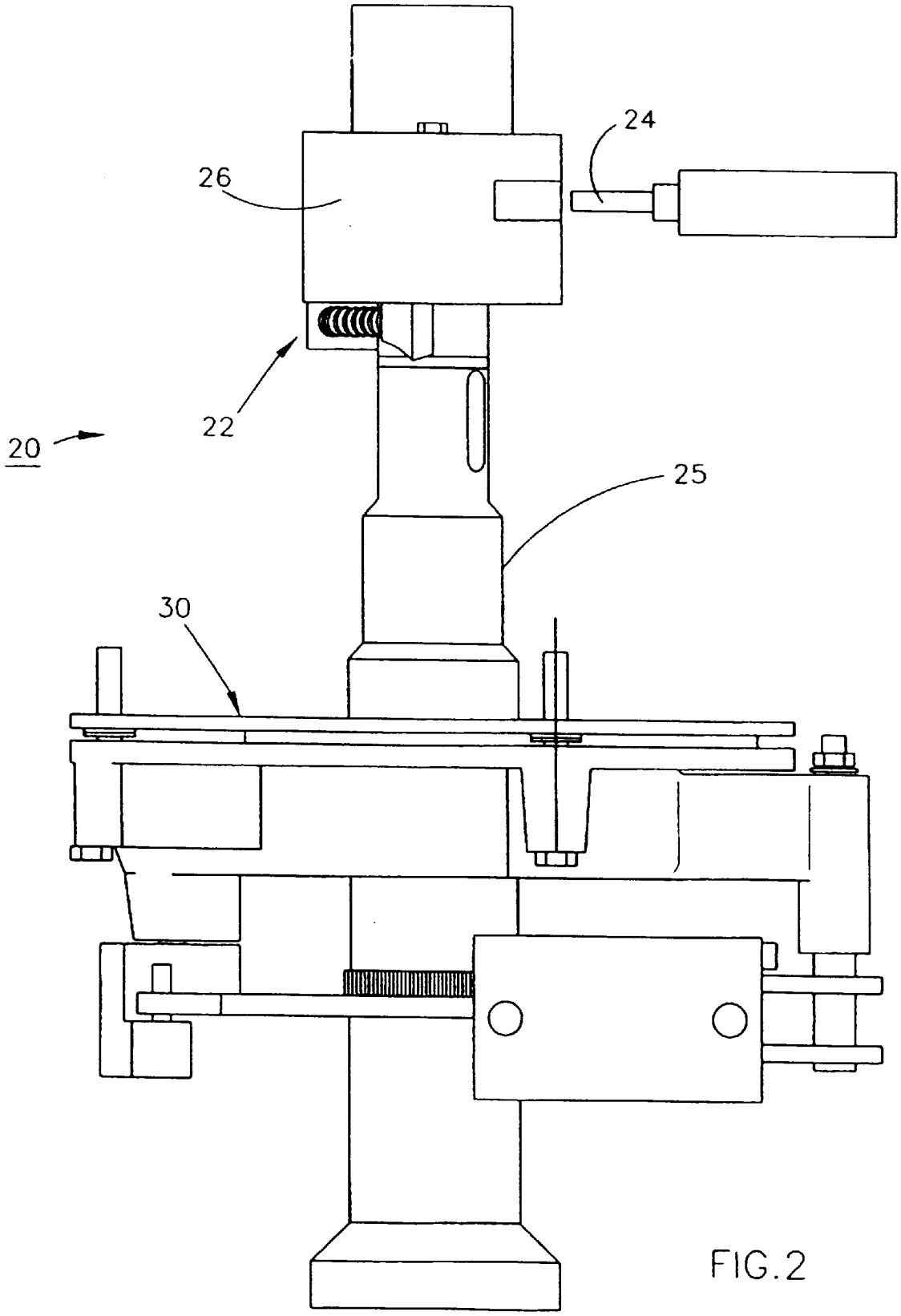
FIG. 2 illustrates a front enlarged view of the fusing assembly of the circular knitting machine shown in FIG. 1.

The circular knitting machine 10 further comprises an end closure assembly 20 connected downstream from the circular knitting element 12. The end closure assembly 20 preferably comprises a fusing assembly which is located downstream from the cutting assembly 45, for example as disclosed in U.S. Pat. No. 5,417,089. As best shown in FIG. 2, the fusing assembly 20 further comprises a tube constrictor 22, preferably a hot air nozzle 24, which is activated by a solenoid and air cylinder assembly (not shown) controlled by the control system 42.

Figure 4:
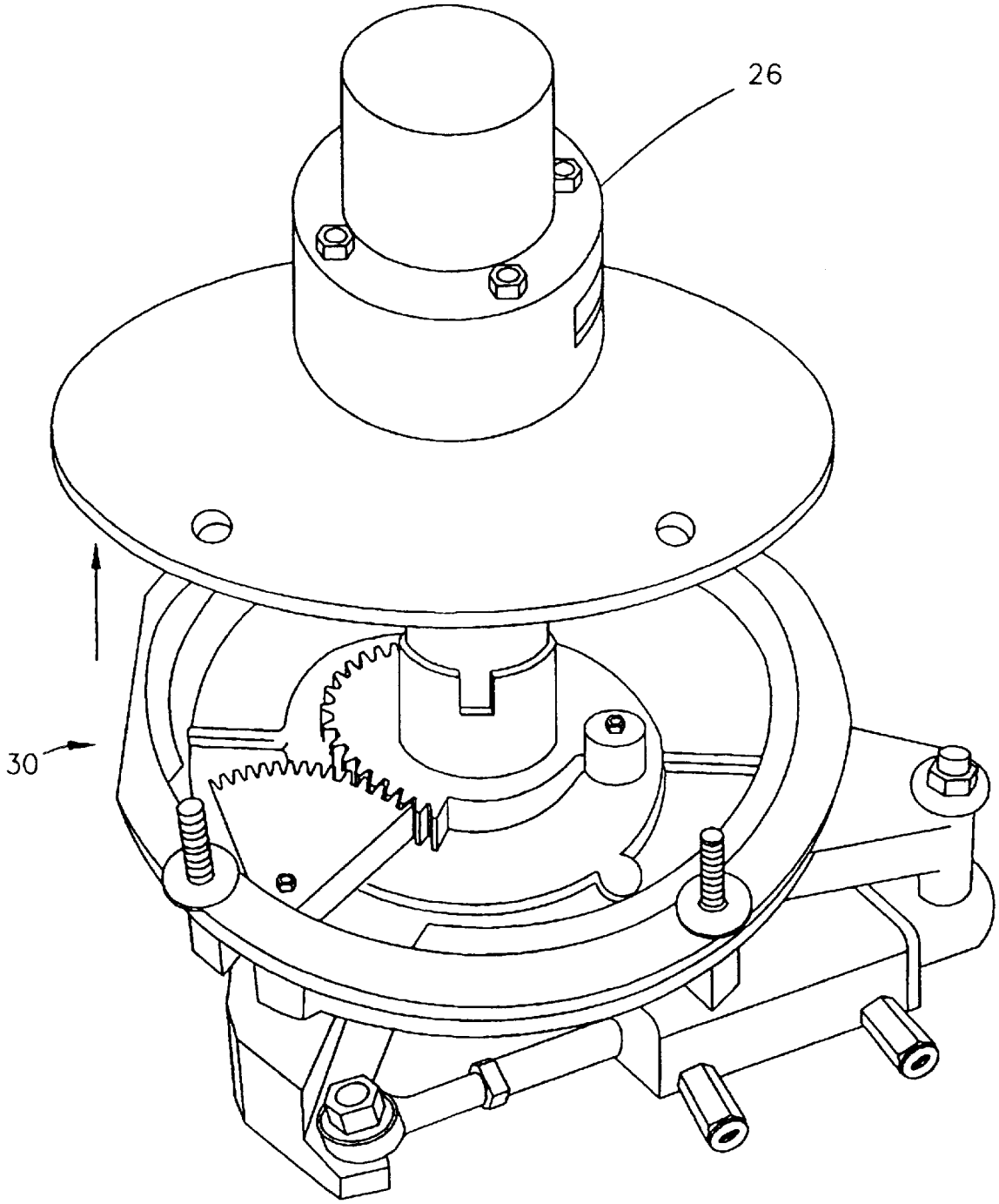
FIG. 4 illustrates a top view of the gear arrangement of the circular knitting machine for producing a tubular knitted article having a closed end, according to the present invention.

In the preferred embodiment, as best seen in FIG. 2, it is critical that the solenoid and air cylinder assembly be in mechanical connection with the tube constrictor 22 via a gear arrangement 30, including a hollow drive shaft 25 extending from the gear arrangement 30 to the tube constrictor 22, in order to avoid binding problems. Further, a tube constrictor heat barrier 26 is axially aligned in surrounding relation to the tube constrictor 22 thereby containing heat from the hot air nozzle 24 and controlling heat for uniform sealing of the tubular knitted article 8. The tube constrictor 22 is activated by the control system 42 via the gear arrangement 30, also seen in FIG. 4, and hollow drive shaft 25 when the tubular knitted fabric 9 which is being produced by the circular knitting machine 10 extends down the accumulator tube 32, beyond the first and second extension tubes 50, 52, respectively, through the tube constrictor 22, and past an end sensor 44, preferably a photocell, which detects the position of the tubular knitted fabric 9.

The photocell 44 electronically signals the control system 42 which activates respective solenoid and air cylinder assemblies (not shown) connected to each of the end closure assembly 20, the accumulator assembly 31, and the actuator assembly 45. A time-out sensor (not shown) is present in the control system to shut-down the circular knitting machine 10 if the tubular knitted fabric 9 is not detected by the photocell 44 within a predetermined amount of time.

In a preferred embodiment, activation of the tube constrictor 22 physically constrains and radially compacts a selected portion of the tubular knitted fabric 9. Simultaneously, the hot air nozzle 24 fuses the constrained and compacted portion of the tubular knitted fabric 9 and the knife 60 severs the tubular knitted fabric 9 to form a tubular knitted article 8 with a closed end. Further, the vacuum is diverted to apply reverse vacuum tension on the tubular knitted fabric 9, as described in the foregoing.

Thus, two tubular knitted articles 8 each having a closed end are formed in one machine cycle, thereby increasing the machine output and reducing cost. Therefore, the instant invention provides for at least double the production capacity of circular knitting of tubular articles having a closed end.

Certain modifications and improvements will occur to those skilled in the art upon a reading of the foregoing description. By way of example, the closure assembly of the present invention can be used to cut the tubular knitted fabric without sealing either end. Also, the present invention may be used to cut, fuse, or both cut and fuse material which has been pre-knitted on a separate circular knitting machine. It should be understood that all such modifications and improvements have been deleted herein for the sake of conciseness and readability but are properly within the scope of the following claims.

I claim:

1. A circular knitting machine for producing a tubular knitted article having a closed end, said apparatus comprising:

(a) a circular knitting element for forming said tubular knitted article;

(b) a closure assembly located downstream of said circular knitting element for forming said closed end; and (c) an accumulator assembly located between said circular knitting element and said closure assembly, said accumulator being operable to permit said circular knitting element to continuously form said tubular knitted article during the operation of said closure assembly.

2. The apparatus according to claim 1, further including a cutting assembly located between said accumulator assembly and said closure assembly, said cutting assembly being operable to cut said tubular knitted article during the operation of said closure assembly.

3. The apparatus according to claim 2, wherein said cutting assembly includes a plenum connected between said accumulator assembly and said closure assembly.

4. The apparatus according to claim 3, wherein said cutting assembly includes a first extension tube connected to said accumulator assembly and a second extension tube connected to said closure assembly, said first and second extension tubes being axially aligned and spaced apart to produce a gap.

5. The apparatus according to claim 4, wherein said cutting assembly includes a cutting means positioned adjacent to said gap.

6. The apparatus according to claim 5, wherein said cutting means positioned adjacent to said gap includes a pair of scissors and an actuator for moving said scissors between an open position and a closed position.

7. The apparatus according to claim 1, wherein said circular knitting element includes four feeds of yarn.

8. The apparatus according to claim 1, wherein said yarn is a thermoplastic.

9. The apparatus according to claim 8, wherein said thermoplastic yarn is nylon.

10. The apparatus according to claim 9, wherein said thermoplastic yarn is 20 denier nylon.

11. The apparatus according to claim 1, wherein said circular knitting element includes about 272 needles.

12. The apparatus according to claim 11, wherein said circular knitting element is adapted to form a tubular knitted article having a Cross-Stretch Value of between 12 and 16 inches.

13. The apparatus according to claim 1, wherein said end closure assembly includes a tube constrictor movable between an open position and a closed position for constricting said tubular knitted article to form a generally solid compact mass and means for cutting and sealing said mass to form two adjacent ends.

14. The apparatus according to claim 13, wherein said means for cutting and sealing said mass to form two adjacent ends is a hot-air nozzle.

15. The apparatus according to claim 14, wherein said tube constrictor further includes a heat barrier surrounding said tube constrictor to retain heat within said tube constrictor.

16. The apparatus according to claim 13, wherein said tube constrictor movable between an open position and a closed position for constricting said tubular knitted article is actuated by a co-aligned outer tube connected to an air cylinder, thereby confining said tube constrictor and said air cylinder to a single axis to prevent binding.

17. An accumulator assembly for a circular knitting machine for producing a tubular knitted article having a closed end, said circular knitting machine including a circular knitting element for forming said tubular knitted article and a closure assembly located downstream of said circular knitting element for forming said closed end, said closure assembly having an open position and a closed position, said apparatus comprising:

(a) a tube located between said circular knitting element and said closure assembly;

(b) a first vacuum source connected to said tube; and (c) a control system for engaging said first vacuum source in response to the operation of said closure assembly to provide tension to said tubular knitted article when said closure assembly is in said closed position, thereby permitting said circular knitting element to continuously form said tubular knitted article during the operation of said closure assembly.

18. The apparatus according to claim 17, further including a second vacuum source downstream from said closure assembly for providing tension to said tubular knitted article when said closure assembly is in said open position and for delivering the completed tubular knitted article to a collection bag.

19. The apparatus according to claim 18, further including a primary vacuum source and a diverter valve connected between said primary vacuum source and said first vacuum source and said second vacuum source to permit said control system to selectively engage one of said first and second vacuum sources.

20. The apparatus according to claim 17, wherein said control system includes an end sensor downstream from said end closure assembly for detecting the end of said tubular knitted article and providing a control signal to operate said end closure assembly and said first vacuum source in response to detection of said end.

21. The apparatus according to claim 20, wherein said end sensor is a photodetector.

22. The apparatus according to claim 20, wherein said control system provides a control signal to shut down said circular knitting machine if the end of said tubular knitted article is not detected within a predetermined time.

23. A circular knitting machine for producing a tubular knitted article having a closed end, said apparatus comprising:

(a) a circular knitting element for forming said tubular knitted article;

(b) a closure assembly located downstream of said circular knitting element for forming said closed end, said closure assembly having an open position and a closed position;

(c) an accumulator assembly located between said circular knitting element and said closure assembly, said accumulator assembly including: (i) a tube located between said circular knitting element and said closure assembly; (ii) a first vacuum source connected to said tube; and (iii) a control system for engaging said first vacuum source in response to the operation of said closure assembly to provide tension to said tubular knitted article when said closure assembly is in said closed position, thereby permitting said circular knitting element to continuously form said tubular knitted article during the operation of said closure assembly; and (d) a cutting assembly located between said accumulator assembly and said closure assembly, said cutting assembly being operable to cut said tubular knitted article during the operation of said closure assembly.

24. The apparatus according to claim 23, wherein said cutting assembly includes a plenum connected between said accumulator assembly and said closure assembly.

25. The apparatus according to claim 24, wherein said cutting assembly includes a first extension tube connected to said accumulator assembly and a second extension tube connected to said closure assembly, said first and second extension tubes being axially aligned and spaced apart to produce a gap.

26. The apparatus according to claim 25, wherein said cutting assembly includes a cutting means positioned adjacent to said gap.

27. The apparatus according to claim 26, wherein said cutting means positioned adjacent to said gap includes a pair of scissors and an actuator for moving said scissors between an open position and a closed position.

28. The apparatus according to claim 23, wherein said circular knitting element includes four feeds of yarn.

29. The apparatus according to claim 23, wherein said yarn is a thermoplastic.

30. The apparatus according to claim 29, wherein said thermoplastic yarn is nylon.

31. The apparatus according to claim 30, wherein said thermoplastic yarn is 20 denier nylon.

32. The apparatus according to claim 23, wherein said circular knitting element includes about 272 needles.

33. The apparatus according to claim 32, wherein said circular knitting element is adapted to form a tubular knitted article having a Cross-Stretch Value of between 12 and 16 inches.

34. The apparatus according to claim 23, wherein said end closure assembly includes a tube constrictor movable between an open position and a closed position for constricting said tubular knitted article to form a generally solid compact mass and means for cutting and sealing said mass to form two adjacent ends.

35. The apparatus according to claim 34, wherein said means for cutting and sealing said mass to form two adjacent ends is a hot-air nozzle.

36. The apparatus according to claim 35, wherein said tube constrictor further includes a heat barrier surrounding said tube constrictor to retain heat within said tube constrictor.

37. The apparatus according to claim 34, wherein said tube constrictor movable between an open position and a closed position for constricting said tubular knitted article is actuated by a co-aligned outer tube connected to an air cylinder, thereby confining said tube constrictor and said air cylinder to a single axis to prevent binding.

38. The apparatus according to claim 23, further including a second vacuum source downstream from said closure assembly for providing tension to said tubular knitted article when said closure assembly is in said open position and for delivering the completed tubular knitted article to a collection bag.

39. The apparatus according to claim 38, further including a primary vacuum source and a diverter valve connected between said primary vacuum source and said first vacuum source and said second-vacuum source to permit said control system to selectively engage one of said first and second vacuum sources.

40. The apparatus according to claim 23, wherein said control system includes an end sensor downstream from said end closure assembly for detecting the end of said tubular knitted article and providing a control signal to operate said end closure assembly and said first vacuum source in response to detection of said end.

41. The apparatus according to claim 40, wherein said end sensor is a photodetector.

42. The apparatus according to claim 40, wherein said control system provides a control signal to shut down said circular knitting machine if the end of said tubular knitted article is not detected within a predetermined time.

43. A method for producing a tubular knitted article having a closed end, said method comprising the steps of:

(a) forming said tubular knitted article using a circular knitting element;

(b) forming said closed end using a closure assembly located downstream of said circular knitting element; and (c) continuously forming said tubular knitted article during the operation of said closure assembly using an accumulator assembly located between said circular knitting element and said closure assembly.

44. A method for controlling an accumulator assembly for a circular knitting machine for producing a tubular knitted article having a closed end, said circular knitting machine including a circular knitting element for forming said tubular knitted article and a closure assembly located downstream of said circular knitting element for forming said closed end, said method comprising the steps of:

(a) receiving said tubular knitted article in a tube located between said circular knitting element and said closure assembly;

(b) providing a first vacuum source connected to said tube; and (c) engaging said first vacuum source in response to the operation of said closure assembly to provide tension to said tubular knitted article when said closure assembly is closed, thereby permitting said circular knitting element to continuously form said tubular knitted article during the operation of said closure assembly.

45. A method for producing a tubular knitted article having a closed end, said method comprising the steps of:

(a) forming said tubular knitted article using a circular knitting element;

(b) forming said closed end using a closure assembly located downstream of said circular knitting element, said closure assembly having an open position and a closed position; and (c) continuously forming said tubular knitted article during the operation of said closure assembly using an accumulator assembly located between said circular knitting element and said closure assembly, said accumulator assembly including: (i) a tube located between said circular knitting element and said closure assembly; (ii) a first vacuum source connected to said tube; and (iii) a control system for engaging said first vacuum source in response to the operation of said closure assembly to provide tension to said tubular knitted article when said closure assembly is in said closed position, thereby permitting said circular knitting element to continuously form said tubular knitted article during the operation of said closure assembly; and (d) cutting said tubular knitted article during the operation of said closure assembly using a cutting assembly locate between said accumulator assembly and said closure assembly.

* * * * *

UNITED STATES PATENT AND TRADEMARK OFFICE

CERTIFICATE OF CORRECTION

PATENT NO. : 5,931,024

DATED : August 3, 1999

INVENTOR(S) : Larry W. Honeycutt

It is certified that error appears in the above-identified patent and that said Letters Patent is hereby corrected as shown below:

In Claim 1:
Line 2, after the word end, insert --from a yarn--.
(a) line 1 after the word for insert --knitting said yarn--.
(a) line 2 after article, insert --of said yarn--.
(c) line 2 after assembly, delete "said accumulator being operable to permit" and insert --thereby premitting--.

In Claim 45:

(d) line 3, change "locate" to --located--.

Signed and Sealed this

Ninth Day of May, 2000

*Attest:*

Q. TODD DICKINSON

*Attesting Officer*

*Director of Patents and Trademarks*